US005718566A

United States Patent [19]

Ikeda et al.

[11] Patent Number: 5,718,566

[45] Date of Patent: Feb. 17, 1998

[54] DRIVE SHAFT LUBRICATION ARRANGEMENT FOR A SWASH PLATE TYPE REFRIGERANT COMPRESSOR

[75] Inventors: Hayato Ikeda; Tomoji Tarutani; Hirofumi Sato; Norikazu Deto, all of Kariya, Japan

[73] Assignee: Kabushiki Kaisha Toyoda Jidoshokki Seisakusho, Kariya, Japan

[21] Appl. No.: 653,446

[22] Filed: May 24, 1996

[30] Foreign Application Priority Data

May 25, 1995 [JP] Japan ..... 7-126897

[51] Int. Cl.[6] ..... F04B 1/18

[52] U.S. Cl. ..... 417/269; 417/313

[58] Field of Search ..... 417/269, 313; 92/154; 184/6.23

[56] References Cited

U.S. PATENT DOCUMENTS 4,019,342 4/1977 Ohta ..... 417/313
4,290,345 9/1981 Hiraga et al. ..... 417/269
4,392,788 7/1983 Nakamura et al. ..... 417/269
5,088,897 2/1992 Kawai et al. ..... 417/269

FOREIGN PATENT DOCUMENTS 3-61680 3/1991 Japan .
5-195949 8/1993 Japan ..... 417/269

*Primary Examiner*—Timothy Thorpe
*Assistant Examiner*—Ted Kim
*Attorney, Agent, or Firm*—Woodcock Washburn Kurtz Mackiewicz & Norris LLP

[57] ABSTRACT

A swash plate type compressor includes an oil separating chamber connected to the discharge chamber for separating lubricant oil from refrigerant gas. A first oil reserve chamber receives the separated oil. A second oil reserve chamber is connected to the first oil reserve chamber. An oil supply port is formed in the valve plate for connecting the second oil reserve chamber to a drive shaft support hole. A restricting member is provided integrally with the discharge valve for regulating the amount of the lubricant oil that passes through the oil supply port.

24 Claims, 5 Drawing Sheets

1
1a'
1b
2
2a'
2b
2c
3
4
5
6
7
8
9
9a
10
10a
11
12
13
14
15
16
17
18
19
20
21
22
23
24
25
26
27
28
29
30
37
40
41
48
49
50
51
71
72
L

DRIVE SHAFT LUBRICATION ARRANGEMENT FOR A SWASH PLATE TYPE REFRIGERANT COMPRESSOR

BACKGROUND OF THE INVENTION

1. Field of the Invention

The present invention relates to swash plate type compressors, and more particularly, to swash plate type compressors that are provided with a mechanism which separates lubricant from refrigerant gas.

2. Description of the Related Art

In swash plate type compressors, which are mainly used in vehicle air-conditioning systems, misted lubricant is typically suspended in refrigerant gas in order to lubricate movable parts. Unfortunately, however, when lubricant particles are discharged into a refrigerating circuit together with the refrigerant gas, the lubricant particles tend to adhere to the inner walls of an evaporator in the refrigerating circuit. This causes a reduction in heat exchange efficiency.

In a prior attempt to cope with this, an oil separator was provided separately in the passage between the compressor and a condenser. The lubricant separated by the oil separator was returned to the compressor through pipes. However, the oil separator and additional pipes resulted in a complicated refrigerating circuit structure. In addition, problems such as clogging may occur in the long pipes, the diameter of which is small. As a result, compressors provided with a built-in oil separating mechanism have been proposed recently.

In compressors with built-in oil separating mechanisms, an oil reserve compartment is connected with a low pressure zone (e.g., a crank chamber) by an oil hole. The oil reserve compartment is where the lubricant separated from the refrigerant at the compressor is recovered. The low pressure zone is where the separated lubricant is returned to. In typical compressors provided with the built-in separator, various valve devices such as float valves have been provided to maintain the flow rate of the returning lubricant at an appropriate value and to suppress reversed flow of the high pressure refrigerant gas passing through the oil hole. However, the small cross-sectional area of the oil hole may, in some cases, hinder the operation of the valves.

Additionally, since the refrigerant gas flows along the walls of the crank chamber after entering the chamber through a suction port, the refrigerant gas near the center of the chamber tends to carry less lubrication. As a result, despite the return of separated lubricant to the crank chamber, there is apt to be insufficient lubrication in the chamber, especially in radial bearings that support the drive shaft. Furthermore, there is a type of compressor which employs slide bearings instead of needle bearings, such as roll bearings, to reduce the weight of the compressor and simplify its structure. The slide bearings are utilized as the thrust bearings that receive the load applied to a swash plate. However, when using slide bearings, the clearance between the bearing and its contacting surface is smaller than that of roll bearings. Thus, adequate lubrication of the surface on which the slide bearing slides is difficult to achieve. As a result, early wear may also occur in the thrust bearings, which are constituted by slide bearings.

SUMMARY OF THE INVENTION

Accordingly, it is a primary objective of the present invention to provide a compressor that does not require a float valve for an oil hole that collects lubricant separated from a refrigerant, and thus results in a simplified structure.

It is another objective of the present invention to provide a compressor capable of smoothly lubricating bearings for rotating parts, such as a swash plate or a drive shaft.

To achieve the above objectives, a swash plate type compressor according to a first aspect of the invention has a casing having a crank chamber, a bore, a pair of shaft holes, a suction chamber, a discharge chamber, a drive shaft inserted into the shaft holes and rotatably supported by the casing, a swash plate located in the crank chamber and mounted on the drive shaft for integral rotation with the drive shaft, a piston reciprocating within the bore according to the rotation of the drive shaft, and a valve plate having a suction port and a discharge port, each corresponding to the bore. The valve plate has a suction valve selectively opening and closing the suction port and a discharge valve selectively opening and closing the discharge port. Refrigerant gas mixed with a lubricant oil is drawn from the suction chamber through the suction port to the bore. The refrigerant gas is compressed in the bore and then discharged into the discharge chamber through the discharge port. The compressor includes an oil separating chamber connected to the discharge chamber for separating the lubricant oil from the refrigerant gas, a first oil reserve chamber connected to the oil separating chamber for recovering the separated oil, a second oil reserve chamber connected to the first oil reserve chamber and provided in the casing, an oil supply port formed with the valve plate for connecting the second oil reserve chamber to the shaft hole, and a restricting passage provided with the discharge valve for regulating the amount of the lubricant oil that passes through the oil supply port.

According to another aspect of the invention an improved compressor of the type that includes a casing, a drive shaft, and a mechanism for compressing a refrigerant that has a lubricant suspended therein when the drive shaft is turned includes a separating system for separating lubricant from the refrigerant; a reserving system, in communication with the separating system, for storing the separated lubricant; a supply port for communicating the reserving system to a portion of the drive shaft for which lubrication is desired; and a restriction systems, interposed in the supply port, for regulating the amount of lubricant that passes through the supply port, whereby an optimum amount of lubricant may be provided to the drive shaft.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
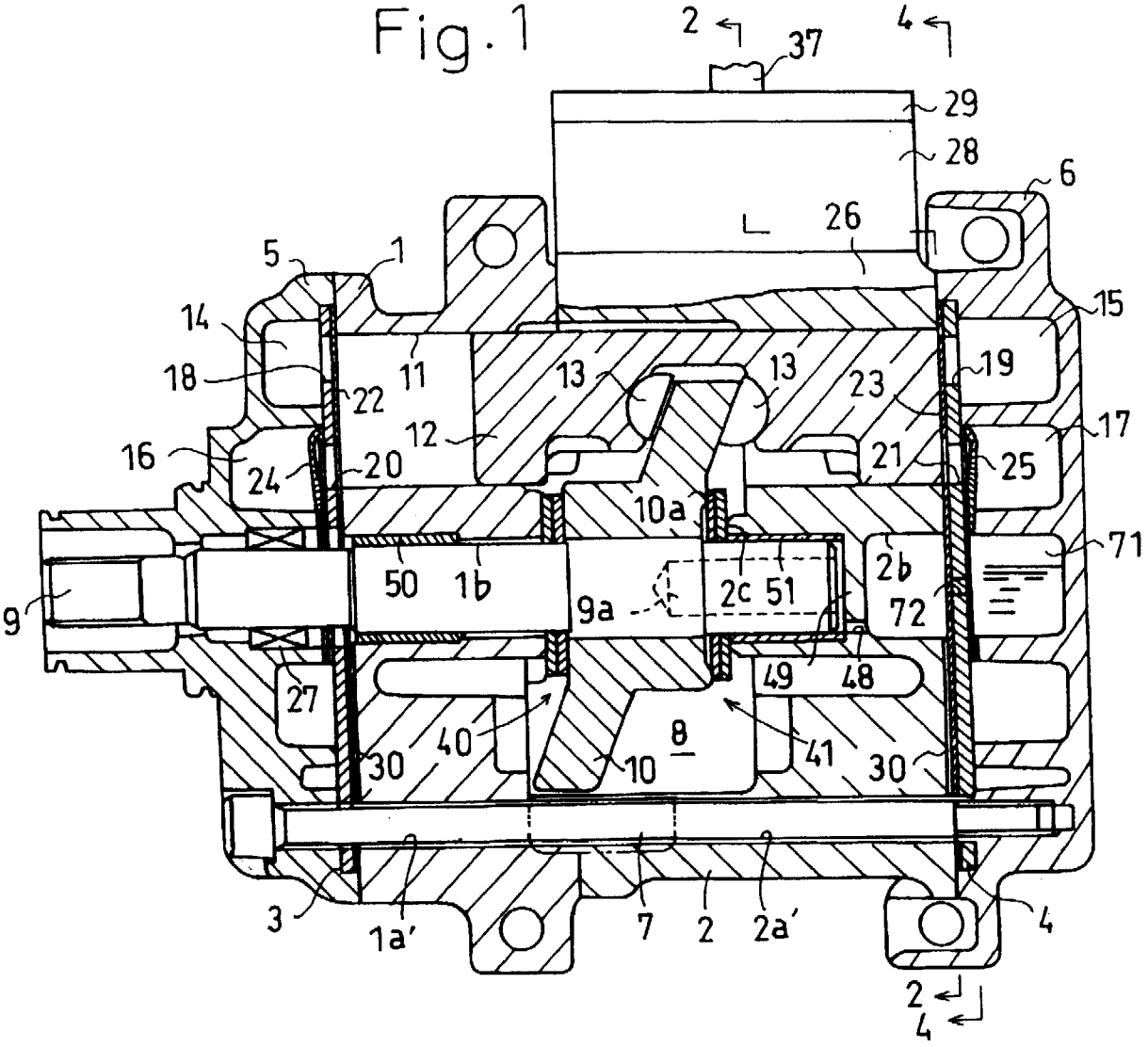
FIG. 1 is a cross-sectional side view showing a swash plate type compressor according to a first embodiment of the present invention.
Figure 2:
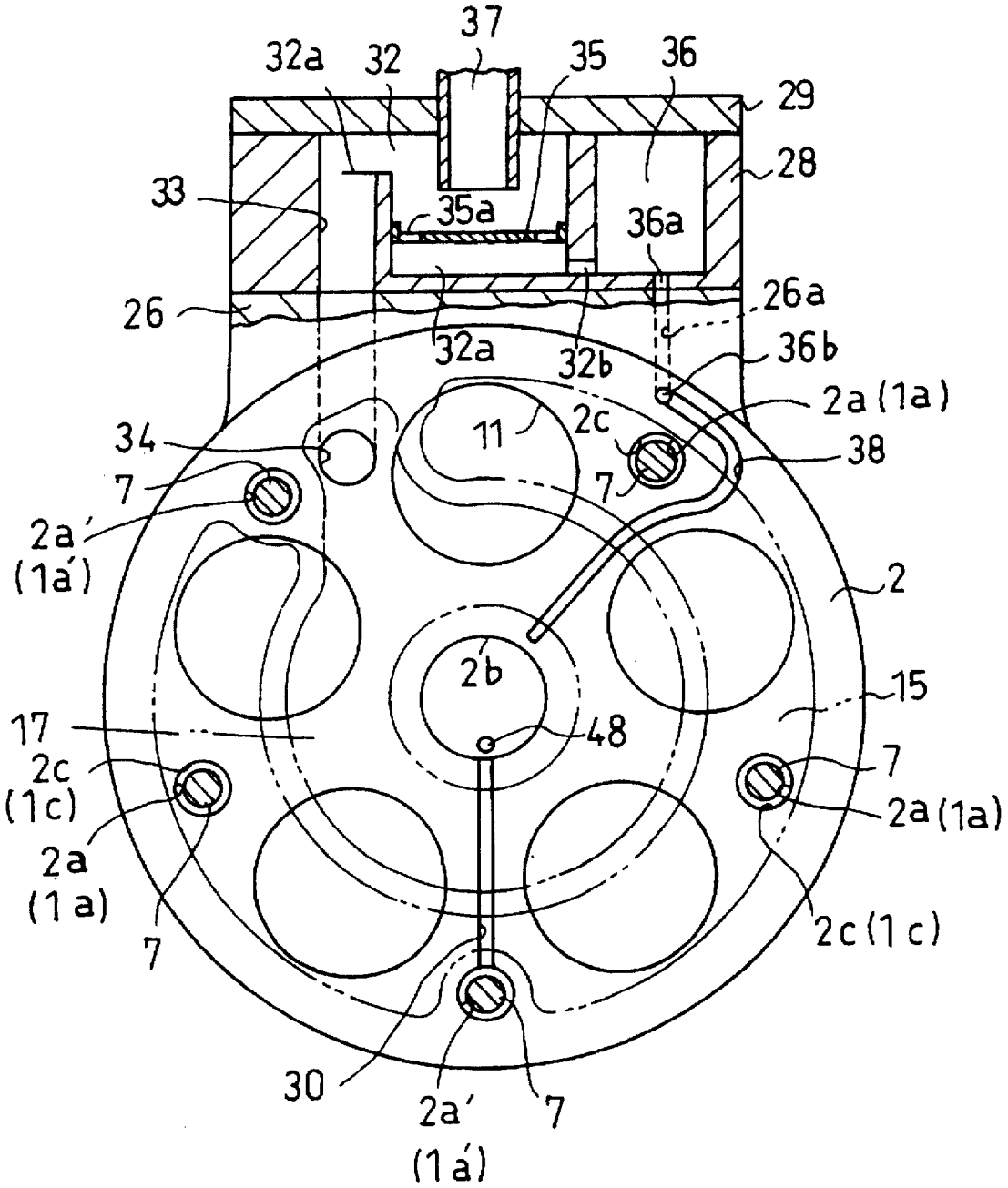
FIG. 2 is a cross-sectional rear view as seen approximately in the direction indicated by line 2—2 showing a rear cylinder block provided with an oil separating mechanism.

As shown in FIGS. 1 and 2, a swash plate type compressor, provided with five double-headed pistons, includes a pair of coupled cylinder blocks 1, 2. The front end of the block 1 is closed by a front housing 5 with a valve plate 3 provided in between, while the rear end of the block 2 is closed by a rear housing 6 with a valve plate 4 provided in between. These parts are fastened to one another by five bolts 7. Each bolt 7 is inserted into a pair of aligned bolt holes 1*a*, 2*a*, extending through the blocks 1, 2, respectively, and the associated bolt holes formed in the valve plates 3, 4. A crank chamber 8 is, defined in the joint section of the blocks 1, 2. A drive shaft 9 is inserted into shaft holes 1*b*, 2*b* formed in the blocks 1, 2, respectively. A swash plate 10 is fixed to the shaft 9 and accommodated in the crank chamber 8. Five pairs of aligned bores 11 are formed in the blocks 1, 2. The axes of the bores 11 extend in a direction parallel to the shaft 9 and are all located the same distance from the axis of the shaft 9. A double-headed piston 12 is accommodated in each pair of bores 11 and coupled to the swash plate 10 by hemispheric shoes 13.

The front and rear housings 5, 6 are provided with suction chambers 14, 15, respectively, defined at their peripheral sections and discharge chambers 16, 17, respectively, defined at their inner sections. The front and rear valve plates 3, 4 are provided with suction holes 18, 19, respectively, and discharge holes 20, 21, respectively. Low pressure refrigerant gas is drawn into each bore 11 from the suction chambers 14, 15 through the associated suction holes 18, 29. High pressure refrigerant gas, compressed in each bore 11, is discharged into the discharge chambers 16, 17 through the associated discharge holes 20, 21. Suction valves 22, 23 are provided on the valve plates 3, 4, respectively. Discharge valves 24, 25 are provided on the valve plates 3, 4, respectively.

A seat 26 is provided at the upper section of the rear cylinder block 2. A suction port (not shown), which has an opening in the crank chamber 8, is formed in the seat 26. As shown in FIG. 2, suction passages 1*c*, 2*c* are defined in three of the five bolt holes 1*a*, 2*a* and connect the crank chamber 8 with the suction chambers 14, 15, respectively. The suction passages 1*c*, 2*c* are defined by the space between the walls of each bolt hole 1*a*, 2*a* and the surface of the bolt 7 accommodated therein. Refrigerant gas drawn into the crank chamber 8 from the suction port flows through the suction passages 1*c*, 2*c* into the suction chambers 14, 15. As shown in FIG. 1, a seal 27 is located between the front housing 5 and the shaft 9.

Figure 3:
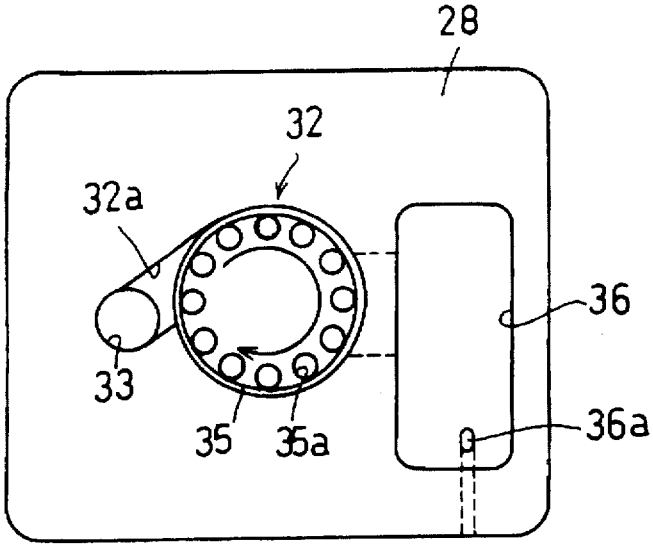
FIG. 3 is a plan view showing the oil separating mechanism with the lid removed.

As shown in FIGS. 2 and 3, a shell 28 is mounted on the seat 26. A cyclone type oil separating chamber 32, which is a substantially cylindrical space, is defined in the shell 28. A guide 32*a* is formed in the upper section of the shell 28. The guide 32*a* extends along a tangential line of the circumferential surface of the separating chamber 32 and is connected to a hole 33 formed in the shell 28. The hole 33 is connected to the discharge chambers 16, 17 through a pair of aligned discharge passages 34, one of which is formed in each block 1, 2.

A partition plate 35 having a plurality of through holes 35*a* is fitted into the separating chamber 32 near its bottom. The partition plate 35 divides the separating chamber 32 into two sections. The lower section 32*a* of the separating chamber 32*b* is connected to a primary reserve chamber 36, where lubricant is collected, by a communicating hole 32*b*. A hole 36*a* is formed in the bottom of the primary reserve chamber 36. The hole 36*a* is connected to an opening 36*b*, which is provided in the outer end face of the rear cylinder block 2, through a conduit 26*a* formed in the seat 26. A first oil passage 38 is formed in the outer end face of the block 2 and a second oil passage 39 (see FIG. 5) is formed in the valve plate 4. A main reserve chamber 71 is defined in the center section of the rear housing 6. Accordingly, the opening 36*b*is connected to the main reserve chamber 71 by way of the first and second oil passages 38, 39, as shown in FIGS. 2 and 5.

A lid 29 is mounted on the shell 28 to close the upper openings of the primary reserve chamber 36 and the oil separating chamber 32. A discharge pipe 37 is fixed to the lid 29. The pipe 37 extends through the lid 29 and has a first end located in the center section of the separating chamber 32 and a second end connected to an external refrigerating circuit (not shown).

Figure 4:
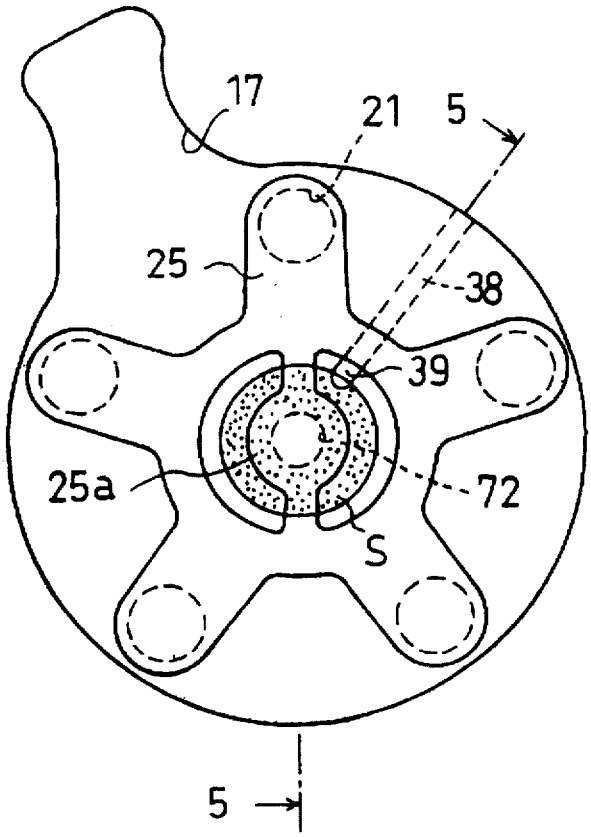
FIG. 4 is a partial rear view showing a restricting member and a clearance approximately as viewed from the plane indicated by line 4—4 in FIG. 1.
Figure 5:
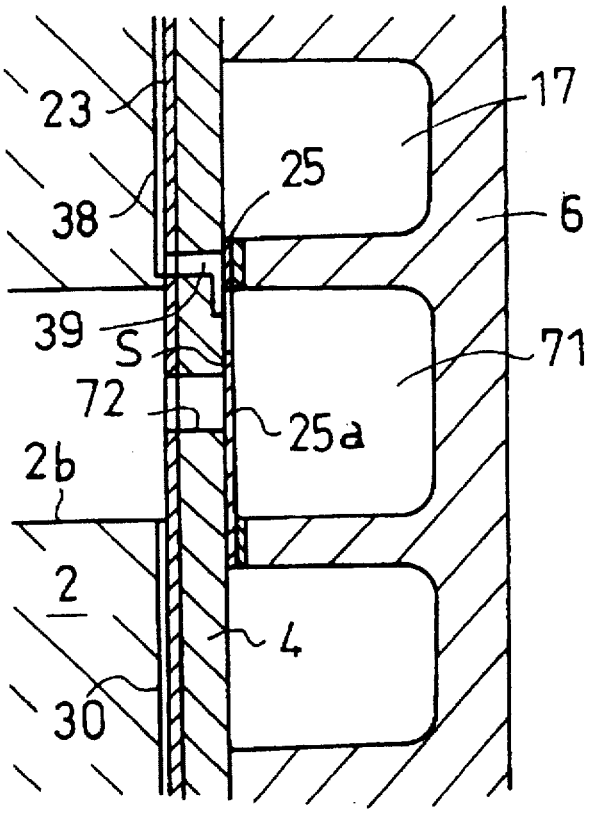
FIG. 5 is an enlarged cross-sectional view along the plane indicated by line 5—5 in FIG. 4.
Figure 5A:
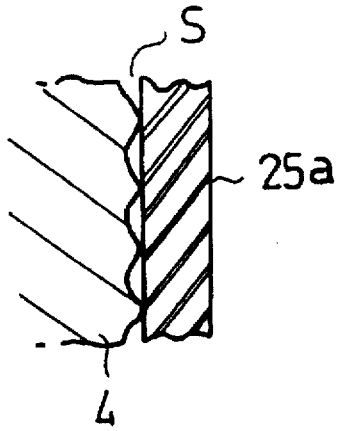
FIG. 5A is a partially enlarged cross-sectional view of FIG. 5 illustrating the clearance.

As shown in FIGS. 4 and 5, the main reserve chamber 71 is axially spaced from the shaft hole 2*b* and is connected to the shaft hole 2*b* through a lubricating hole 72, which extends through the valve plate 4. The inlet of the lubricating hole 72, located on the main reserve chamber 71 side of the valve plate 4, is covered by a substantially round restricting member 25*a*, which extends integrally from the material forming the discharge valve 25. Rough machining is applied to the area near the inlet of the lubricating hole 72 on the surface of the valve plate 4. The rough machining of the surface of the valve plate 4 results in a slight clearance S defined between the valve plate 4 and the restricting member 25*a* around the inlet of the lubricating hole 72. Accordingly, passage between the main reserve chamber 71 and the shaft hole 2*b* is tolerated only through the small clearance S. The clearance S may also be created by forming a plurality of microscopic grooves in the surface of the valve plate 4 instead of roughly machining the surface.

The shaft hole 2*b* is divided into two sections by a partition 49 as seen in FIG. 1 radial bearing 51, which is a slide bearing, is accommodated in the front section of the shaft hole 2*b* to support the rear end of the shaft 9. The front end of the shaft 9 is supported by a radial bearing 50, which is also a slide bearing and which is provided in the shaft hole 1*b*.

The partition 49 is provided with an oil passage 48 to connect the front and rear sections of the shaft hole 2*b*. An oil sump 9*a* is formed in the shaft 9 to extend along the axis of the shaft. The oil sump 9*a* opens at the rear end of the shaft 9 and is thus connected to the oil passage 48. Thrust bearings 40, 41 are provided between the swash plate 10 and the blocks 1, 2 to receive the load applied to the swash plate 10 in the axial direction. Slide bearings are also employed as the thrust bearings 40, 41, and like the radial bearings 50, 51, they require lubrication.

An oil groove 30 is provided on the outer end face of each block 1, 2. The oil grooves 30 connect one of the remaining bolt holes 1*a*', 2*a*', which does not have a suction passage defined therein, to the associated shaft holes 1*b*, 2*b*. As shown in FIG. 1, the bolt hole 1*a*', 2*a*', connected to the oil groove 30, is isolated from the crank chamber 8 and the suction chambers 14, 15 and thus defines an independent oil passage. Instead of forming only one oil groove 30 per block, oil grooves 30 may be formed between both bolt holes 1*a*, 2*a*, and the associated shaft holes 1*b*, 2*b* on each block 1, 2.

Rotation of the shaft 9 causes the rotational movement of the swash plate 10 to be converted to linear reciprocating movement of each piston 12 in the associated bore 11. The reciprocation of each piston 12 results in suction, compression, and discharge of refrigerant gas. Compressed high pressure refrigerant gas is drawn into the oil separating chamber 32 by way of the discharge chambers 16, 17, the discharge passage 34, the hole 33, and the guide 32*a*.

The refrigerant gas from the hole 33 flows along the inner walls of the guide 32*a* when being introduced into the separating chamber 32. The flow of refrigerant gas causes a rotating current in the direction indicated by an arrow in FIG. 3. Centrifugal force resulting from the rotating current effectively separates the lubricant particles suspended in the refrigerant gas. By undergoing the oil separating process, pulsation of the refrigerant gas is reduced. Thus, the refrigerant gas is sent to the refrigerating circuit in an extremely stable state.

The lubricant separated from the refrigerant gas falls along the walls of the separating chamber 32 onto the partition plate 35. The lubricant then falls through the through holes 35*a* and is recovered in the primary reserve chamber 36. The lubricant is then conveyed through the hole 36*a* and the oil passages 38, 39 and introduced into the main reserve chamber 71 to be collected therein.

The main reserve chamber 71 is axially spaced from the shaft hole 2*b* with the lubricating hole 72 of the valve plate 4 located in between. However, since the inlet of the lubricating hole 72 is covered by the restricting member 25*a*, passage between the main reserve chamber 71 and the shaft hole 2*b* is tolerated only through the clearance S. Accordingly, the lubricant inside the main reserve chamber 71 flows through the lubricating hole 72 into the shaft hole 2*b* by way of the clearance S. A portion of the lubricant flows through the oil passage 48 and is collected in the oil sump 9*a* of the shaft 9. The remaining lubricant lubricates the radial bearing 51 and the thrust bearing 41, which are located near the shaft 9, in accordance with the pressure gradient of the compressor, and is then returned to the crank chamber 8.

The present invention positively lubricates the radial bearings 50, 51 and the thrust bearings 40, 41 by utilizing the lubricant returned the crank chamber 8. The present invention also simplifies the structure of the compressor by employing slide bearings instead of the needle bearings used in the prior art.

In other words, the lubricant that flows into the shaft hole 2*b* from the main reserve chamber 71 is supplied to the shaft hole 1*b* by way of the oil grooves 30, formed in the blocks 1, 2, and the bolt holes 1*a*', 2*a*'. The lubricant flowing from the shaft hole 1*b* sufficiently lubricates the radial bearing 50, the thrust bearing 40, and the seal 27. Therefore, the above-described improvement in the lubricating mechanism allows slide bearings to be employed as the radial bearings 50, 51 and the thrust bearings 40, 41.

According to the present invention, a sufficient amount of lubricant in the main reserve chamber 71 is ensured by the clearance S, which serves to control the flow rate of the lubricant. In addition, lubricant is also reserved in the oil sump 9*a* in the shaft 9. This structure prevents a shortage of lubricant.

Figure 6:
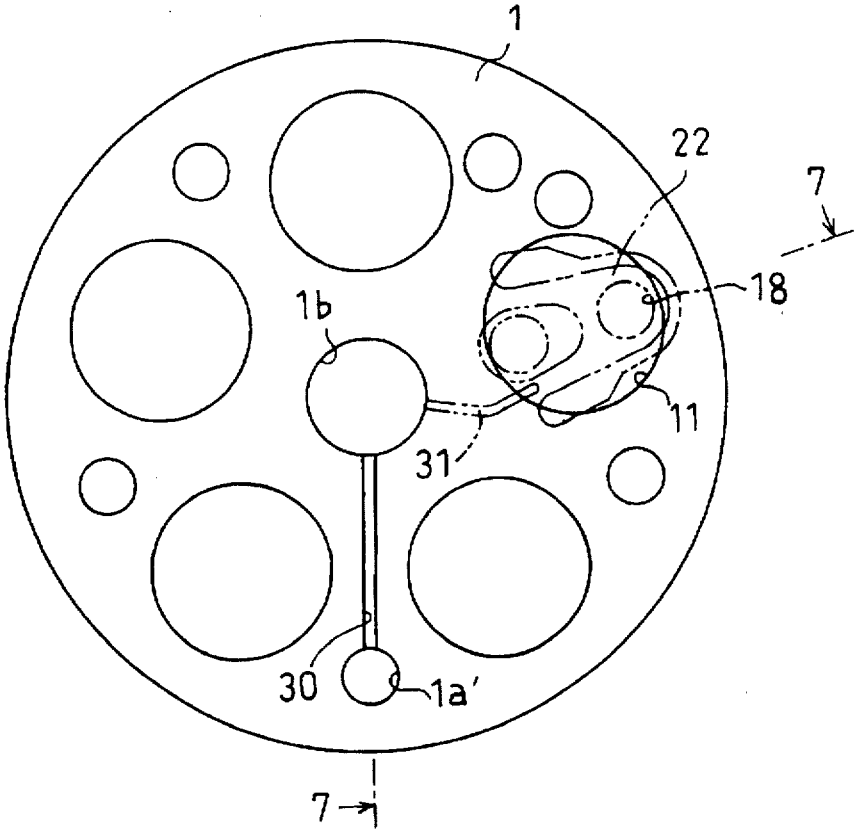
FIG. 6 is a front view showing a front cylinder block of a swash plate type compressor according to another embodiment of the present invention.
Figure 7:
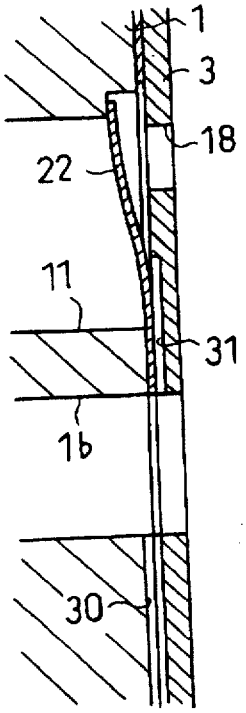
FIG. 7 is an enlarged cross-sectional view along the plane indicated by line 7—7 in FIG. 6.

The clearance S and the restricting member 25*a* impedes a reversed flow of high pressure refrigerant gas, directed toward the inside of the shaft hole 1*b* during a shortage of lubricant in the main reserve chamber 71. The restricting member 25*a* is formed integrally with the discharge valve 25, and the clearance S is obtained by machining the valve plate 4. Therefore, a separate valve for prevention of reversed flow is not required to be provided in the lubricant passage. Furthermore, since the restricting member 25*a* is always located close to the inlet of the lubricating hole 72*a*, foreign matter is prevented from entering the bore hole 2*b*. FIGS. 6 and 7 illustrate a modification of the front valve plate 3. A pressurizing groove 31, connecting the shaft hole 1*b* with the bore 11, is formed in the valve plate 3. The pressurizing groove 31 connects the bore 11 with the shaft hole 1*b* when the suction valve 22 opens the suction hole 18. Therefore, the pressure in the shaft hole 1*b* drops intermittently during operation of the compressor. The intermittent pressure drops result in lubricant being drawn into the shaft hole 1*b* through the oil groove 30. This structure enables the front bearings 40, 50 to be lubricated in the same manner as the rear bearings 41, 51.

Although only two embodiments of the present invention have been described herein, it should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope of the appended claims.

What is claimed is:

1. A swash plate type compressor including a casing having a crank chamber, a bore, a pair of shaft holes, a suction chamber, a discharge chamber, a drive shaft inserted into the shaft holes and rotatably supported by the casing, a swash plate located in the crank chamber and mounted on the drive shaft for integral rotation with the drive shaft, a piston reciprocating within the bore according to the rotation of the drive shaft, and a valve plate having a suction port and a discharge port, each corresponding to the bore, and a suction valve member selectively opening and closing said suction port and a discharge valve member selectively opening and closing said discharge port, wherein a refrigerant gas mixed with a lubricant oil is drawn from the suction chamber through the suction port to said bore, said refrigerant gas being compressed in the bore and then discharged into said discharge chamber through the discharge port, said compressor comprising:

an oil seperating chamber connected to said discharge chamber for separating said lubricant oil from said refrigerant gas;

a first oil reserving chamber connected to said oil separating chamber for recovering the separated oil;

a second oil reserving chamber connected to said first oil reserving chamber and provided in said casing;

an oil supply port formed with said valve plate for connecting said second oil reserving chamber to said shaft hole; and a restricting passage provided with said discharge valve member for regulating the amount of said lubricant oil that passes through said oil supply port.

2. A compressor according to claim 1, wherein said casing includes:

front and rear cylinder blocks joined with each other; and front and rear housings respectively joined with said front and rear cylinder blocks, said crank chamber being defined between said front and rear cylinder blocks.

3. A compressor according to claim 2, wherein said shaft holes are formed respectively in said front and rear cylinder blocks to be coaxial, and wherein said bore is one of a plurality of bores formed in said front and rear cylinder blocks, the axes of which are located on a circle concentric to said shaft holes, and wherein said piston is one of a plurality of pistons, each having head portions at opposite ends thereof, and wherein said suction chamber, said discharge chamber and said valve plate are ones of a pair of each, so that one of each corresponds to each head of the piston.

4. A compressor according to claim 2, wherein said second oil reserve chamber is provided with said rear housing and said oil supply port connecting said second oil reserve chamber to said shaft hole of said rear cylinder block, wherein said front and rear cylinder blocks have a plurality of aligned pairs of through holes penetrating said cylinder blocks and connected with each other, and wherein said compressor further includes a bolt inserted into each of the pairs of through holes to fasten said front and rear housings with each other while said front and rear housings clamp said valve plates with the associated front and rear cylinder blocks.

5. A compressor according to claim 4, wherein said front and rear cylinder blocks each have a radial passage that connects said oil supply port to one of said shaft holes through at least one of the aligned pairs of through holes.

6. A compressor according to claim 4, wherein at least one of the aligned pairs of through holes connects said suction chamber to said crank chamber.

7. A compressor according to claim 2, wherein said rear cylinder block has a seat formed on its outer periphery, said seat serving to mount said oil separating chamber and said first oil reserve chamber to the rear cylinder block.

8. A compressor according to claim 7, wherein said seat has a discharge passage formed therein for connecting said discharge chamber to said oil separating chamber;

wherein a partition plate is provided for dividing said oil separating chamber into first and second divided sections, said partition plate having a plurality of holes, wherein said first divided section is connected to said discharge passage and said second divided section connecting the oil separating chamber to the first oil reserve chamber; and wherein said oil separating chamber separates said lubricant oil from said refrigerant gas when said refrigerant gas within said discharge chamber is introduced into said first divided section.

9. A compressor according to claim 7 further comprising an oil delivery passage formed in said seat and said rear cylinder block for connecting said first oil reserve chamber to said second oil reserve chamber.

10. A compressor according to claim 9, wherein part of said oil delivery passage is formed between said rear cylinder block and said valve plate.

11. A compressor according to claim 1, wherein the surface of said valve plate is roughened to form a clearance between said discharge valve member and said valve plate around said oil supply port.

12. A swash plate type compressor including:

front and rear cylinder blocks joined with each other and having a crank chamber defined therebetween, said front and rear cylinder blocks having front and rear housings joined with the associated cylinder blocks and suction and discharge chambers defined between each cylinder block and the associated housing, said front and rear cylinder blocks further including a pair of coaxial shaft holes and a plurality of bores, the axes of which are located on a circle concentric with said shaft holes;

a drive shaft inserted into said shaft holes and rotatably supported by said front and rear cylinder blocks;

a swash plate located in the crank chamber and mounted on the drive shaft for integral rotation with the drive shaft;

a plurality of pistons respectively reciprocating in the bores according to the rotation of the swash plate;

a pair of valve plates, each of which is located between one of the cylinder blocks and the associated housing, each valve plate having a suction port and a discharge port for each bore, and a suction valve member selectively opening and closing each suction port and a discharge valve member selectively opening and closing each discharge port, wherein a refrigerant gas mixed with a lubricant oil is drawn from said suction chamber through each suction port to each bore, said refrigerant gas being compressed in each bore and then discharged into said discharge chamber through each discharge port;

an oil separating chamber located at said rear cylinder block and connected to said discharge chamber for separating said lubricant oil from said refrigerant gas;

a first oil reserving chamber connected to said oil separating chamber for recovering the separated oil;

a second oil reserving chamber connected to said first oil reserving chamber and provided in said rear housing;

an oil supply port formed in one of said valve plates for connecting said second oil reserving chamber to one of said shaft holes; and a restricting member formed integrally with one of said discharge members for regulating the amount of said lubricant oil that passes through said oil supply port.

13. A compressor according to claim 12, wherein said front and rear cylinder blocks have a plurality of aligned pairs of through holes penetrating said cylinder blocks and connected with each other, wherein said compressor further includes a bolt inserted into each of the pairs of through holes to fasten said front and rear housings with each other while said front and rear housings clamp said valve plates with the associated front and rear cylinder blocks.

14. A compressor according to claim 13, wherein said front and rear cylinder blocks each have a radial passage that connects said oil supply port to one of said shaft holes through at least one of the aligned pairs of through holes.

15. A compressor according to claim 13, wherein at least one of the aligned pairs of through holes connects said suction chamber to said crank chamber.

16. A compressor according to claim 12, wherein said rear cylinder block has a seat formed on its outer periphery, said seat serving to mount said oil separating chamber and said first oil reserve chamber to the rear cylinder block.

17. A compressor according to claim 16, wherein said seat has as a discharge passage formed therein for connecting said discharge chamber to said oil separating chamber;

wherein a partition plate is provided for dividing said oil separating chamber into first and second divided sections, said partition plate having a plurality of holes, wherein said first divided section is connected to said discharge passage and said second divided section connecting the oil separating chamber to the first oil reserve chamber; and wherein said oil separating chamber separates said lubricant oil from said refrigerant gas when said refrigerant gas within said discharge chamber is introduced into said first divided section.

18. A compressor according to claim 16 further comprising an oil delivery passage formed in said seat and said rear cylinder block for connecting said first oil reserve chamber to said second oil reserve chamber.

19. A compressor according to claim 18, wherein part of said oil delivery passage is formed between said rear cylinder block and one of said valve plates.

20. A compressor according to claim 12, wherein the surface of said one of said valve plates is roughened to form a clearance between said restricting member and said valve plate around said oil supply port.

21. A compressor of the type that includes a casing, a drive shaft, and a mechanism for compressing a refrigerant that has a lubricant suspended therein when the drive shaft is turned, comprising:

separating means for separating lubricant from the refrigerant;

reserving means, in communication with said separating means, for storing the separated lubricant;

a supply port for communicating said reserving means to a portion of said drive shaft for which lubrication is desired;

restriction means, located near said supply port, for regulating the amount of lubricant that passes through said supply port, whereby an optimum amount of lubricant may be provided to the drive shaft; and a valve member for handling flow of the refrigerant within said casing, and wherein said restricting means is integral with said valve member for simplicity of construction.

22. A compressor according to claim 21, wherein said separating means comprises an oil separating chamber.

23. A compressor according to claim 21, wherein said reserving means comprises a first oil reserve chamber connected to said separating means for recovering the separated oil; and a second oil reserve chamber connected to said first oil reserve chamber and provided in said casing.

24. A compressor according to claim 21, wherein said separating means comprises a separating chamber; and a partition plate for dividing said separating chamber into first and second divided sections, said partition plate having a plurality of holes, wherein said first divided section is connected to a discharge passage for refrigerant and said second divided section is connected to said reserving means, whereby said separating chamber separates said lubricant from said refrigerant when said refrigerant is introduced into said first divided section.

* * * * *